US006245957B1

(12) United States Patent
Wagner et al.

(10) Patent No.: US 6,245,957 B1
(45) Date of Patent: Jun. 12, 2001

(54) UNIVERSAL DECONTAMINATING SOLUTION FOR CHEMICAL WARFARE AGENTS

(75) Inventors: George W. Wagner, Elkton, MD (US); Yu-Chu Yang, London (GB)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/388,739

(22) Filed: Sep. 2, 1999

(51) Int. Cl.[7] ..... A62D 3/00

(52) U.S. Cl. ..... 588/200; 588/206; 588/205; 588/218

(58) Field of Search ..... 588/200, 206, 588/218, 221, 205, 238, 242, 244, 246; 252/186.1, 186.28, 186.27, 186.42, 193

(56) References Cited

U.S. PATENT DOCUMENTS 6,106,854 * 8/2000 Belfer et al. ..... 424/405

OTHER PUBLICATIONS

Drago et al., (conference date) 1997, Proceedings from ERDEC Science Conference of Chemical and Biological Defense Research, pp. 341–342.*

* cited by examiner

*Primary Examiner*—Wayne Langel
*Assistant Examiner*—Eileen E. Nave
(74) *Attorney, Agent, or Firm*—Ulysses John Biffoni; Vincent J. Ranucci

(57) ABSTRACT

A chemical warfare agent decontaminating composition of a mixture of a carbonate component, peroxide component, and alcohol component effective to degrade a chemical warfare agent. A method for neutralizing chemical warfare agents also is disclosed.

3 Claims, No Drawings

UNIVERSAL DECONTAMINATING SOLUTION FOR CHEMICAL WARFARE AGENTS

GOVERNMENT INTEREST

The invention described herein may be manufactured, licensed, and used by or for the U.S. Government.

BACKGROUND OF THE INVENTION

1. Field of the Invention

The present invention relates to the decontanination of chemical agents. More particularly, the present invention is a composition, and a method that uses the composition, which decontaminate nerve and mustard chemical warfare agents. The composition is generally non-toxic to handling personnel prior to its use as a decontaminate for chemical warfare agents.

2. Brief Description of the Related Art

Today's military forces are confronted with the possibility of encountering chemical agents in battlefields. Additionally, civilians are at risk to unforeseen chemical leaks and possible terrorist attacks using chemical weapons.

Militarily, decontamination systems are important because they allow rapid decontamination of material in the immediate area of the soldier. They may be liquid solutions or solid sorbents. Decontamination capability allows soldiers to restore materiel contaminated with chemical agents. Rapid decontamination mininizes downtime for soldiers operating within an operating area.

Several types of toxic chemical compounds are known. These include mustard and nerve agents. Mustard agents or gases, also called blister agents, may be nitrogen or chlorinated sulfur compounds. The most common type of mustard agent are the chlorinated sulfur compounds. Long after mustard gas was discovered in 1822, it was used in World War I as a chemical warfare agent, causing approximately 400,000 casualties. The sulphur mustard gas is chemically known as bis-(chloroethyl)-sulphide. The nitrogen mustard gas is chemically known as tris(2-chloroethyl)amine. Mustard gas is a colorless, oily liquid having a garlic or horseradish odor. It is slightly soluble in water, complicating removal by washing. It primarily attacks humans through inhalation and dermal contact, having an Airborne Exposure Limit (AEL) of 0.003 $mg/m^3$. Mustard gas is a vesicant and an alkylating agent which produces a cytotoxic reaction to the hematopoietic tissues. Symptoms usually begin to take effect 4 to 24 hours after initial contact. The rate of detoxification of mustard gas is slow and repeated exposure yields a cumulative effect.

Nerve agents or gases were discovered in 1936, during research on more effective pesticides. Nerve agents inhibit a certain enzymes within the human body from destroying a substance called acetylcholine. This produces a nerve signal within the body forcing the muscles to contract. Nerve agents have an Airborne Exposure Limit (AEL) of 0.00001 $mg/m^3$.

Currently, one of the primary chemical warfare agent decontaminating solutions is Decontamination Solution 2. Decontamination Solution 2, or DS2, is a chemical warfare decontaminating solution used by the United States Army. DS2 contains approximately 70% diethylenetriamine (DETA), 28% ethylene glycol monomethyl ether (EGME), and 2% NaOH by weight, and is used for decontaminating a variety of chemical warfare agents. However, DS2 is toxic, corrosive, flammable and hazardous to the environment.

EGME is teratogenic, and the secondary amine structure in DETA possess a possible health hazard from conversion to a potential N-nitrosoamine carcinogen. DS2 is extremely resistant to biodegradation, particularly with regard to the DETA component of the solution.

Although basic peroxide has been shown to decontaminate GD and GB, it does not individually affect HD, because of both its insolubility in aqueous media and its slow reaction with $OOH^-$. It has been reported in "Catalytic Activation of Hydrogen Peroxide-A Green Oxidant System," by Russell S. Drago, Karen M. Frank, George Wagner, and Yu-Chu Yang in Proceedings of the 1997 ERDEC Scientific Conference on chemical and Biological Defense Research, ERDEC-SP-063, Aberdeen Proving Grounds, Maryland, July 1998, pp. 341–342, that bicarbonate ion dramatically enhances the oxidation of HD by peroxide in water/t-BuOH media via generation of the highly reactive peroxocarbonate, $HCO_4^-$.

SUMMARY OF THE INVENTION

In view of the foregoing, it is therefore an object of the present invention to provide a environmentally safe decontamination solution for chemical warfare agents, such as nerve agents and HD.

It is further an object of the present invention to provide decontamination composition for chemical warfare agents that is safe for human contact and the environment.

These and other objects are achieved by the present invention which includes a chemical warfare agent decontaminating composition comprising a mixture of a carbonate component, peroxide component, and alcohol component effective to degrade chemical warfare agent.

The present invention further includes a method for neutralizing chemical warfare agent comprising the steps of providing a chemical warfare agent decontaminating composition comprising a mixture of a carbonate component, peroxide component, and alcohol component effective to degrade a chemical warfare agent, and, contacting the mixture with a chemical warfare agent.

DETAILED DESCRIPTION OF THE PREFERRED EMBODIMENTS

The present invention is a nerve and mustard agent, especially VX, GB, GD, and HD chemical agents, decontamination composition and method for neutralizing chemical warfare agents with the composition. The composition includes a mixture of carbonate, peroxide and alcohol components. As a suitable replacement for the toxic and corrosive DS2 decontaminant, the present invention has a broad-spectrum reactivity towards all agents, even in cold weather operations, while achieving a significant reduction in the toxic, corrosive and environmentally harmful nature of the decontaminant. The present invention may be used for a broad range of chemical warfare agents and/or decontamination applications, ranging from heavy equipment to sensitive equipment/electronics and personnel. In its preferred embodiment, the composition comprises a solution of baking soda, hydrogen peroxide and alcohol. Baking soda and hydrogen peroxide, when dilute, possess non-irritating characteristics. When formulated with various human-compatible alcohols, e.g. ethanol (grain alcohol), isopropanol (rubbing alcohol) and polypropylene glycol (food additive), the composition of the present invention remains non-irritating and non-toxic. The present invention may also be formulated from food-grade materials, increasing the safety, convenience and universal use of the decontaminant.

The present invention is a chemical warfare agent decontaminating composition comprising a mixture of a carbonate component, peroxide component, and alcohol component effective to degrade a chemical warfare agent. The term "composition" may include, without limitation, sprays, vapors, liquids, solids, and/or other physical forms of mixtures that incorporate the carbonate, peroxide and alcohol components as a unitary decontaminant. Preferably, the mixture comprises a blended liquified combination of the components. A blended liquified combination of the components provides the mixed compounds as uniformly dispersed together within the mixture.

The carbonate component may include any carbonate that is suitable to provide a peroxocarbonate, when reacted. The carbonate non-exclusively includes sodium bicarbonate, potassium bicarbonate, lithium bicarbonate, ammonium hydrogen carbonate, ammonium carbonate and/or combinations thereof Preferably the carbonated component comprises sodium bicarbonate, commonly known as baking soda. This provides a readily convenient source, as baking soda may be acquired at most food distribution localities. The mixture comprises an amount of carbonate sufficient to effectively enhance the oxidation of HD, or the perhydrolysis of nerve agents by a peroxide, alcohol mixture. Preferably, the mixture comprises a carbonate component in an amount of from about 0.01 molar to about 0.7 molar, more preferably from about 0.1 molar to about 0.5 molar, and most preferably from about 0.2 molar to about 0.3 molar.

The present invention further contains a peroxide component, preferably having a molecular weight of from about 1000 or less, more preferably about 500 or less, and most preferably about 200 or less. The preferred peroxide component comprises suitable peroxides that provide a peroxocarbonate, when reacted, preferably hydrogen peroxide and/or derivatives thereof. Liquid hydrogen peroxide or solid urea hydrogen peroxide, when desired, may be used. Solid urea hydrogen peroxide is particularly applicable to address concerns of storage and handling of concentrated aqueous hydrogen peroxide in the field. Solid urea hydrogen peroxide is non-toxic and environmentally friendly.

When used in an aqueous form, the peroxide component preferably comprises hydrogen peroxide in a concentration of from about 3 weight percent to about 50 weight percent. The amount of the hydrogen peroxide component in the mixture may range from about 1 volume percent to about 99 volume percent, more preferably from about 25 volume percent to about 75 volume percent, and most preferably from about 40 volume percent to about 60 volume percent.

The alcohol component of the mixture provides an anti-freeze and co-solvent to the solution. The alcohol also aids in dissolving the chemical warfare agent. The alcohol component may comprise any compound suitable as a co-solvent with lower molecular weight alcohols, such as less than about 300, being particularly desirable. Alcohols may include, without limitation, t-BuOH, ethanol (grain alcohol), isopropanol (rubbing alcohol), propylene glycol (a food additive and non-toxic anti-freeze), polypropylene glycol (a food additive) and/or derivatives and combinations thereof The compound t-BuOH is particularly effective and preferred.

The amount of the alcohol component in the mixture may range from about 1 volume percent to about 99 volume percent, more preferably from about 25 volume percent to about 75 volume percent, and most preferably from about 40 volume percent to about 60 volume percent.

When used on a chemical warfare agent, the above detailed solution is placed in contact with a chemical warfare agent. The contact may be accomplished by immersing a chemical warfare agent covered article in the solution, spraying the solution onto an article, or other contacting means that permit the chemical warfare agent to react with the composition of the present invention, preferably by dissolving the chemical warfare agent into a solution of the composition. Contact may also be accomplished by any combining of the chemical warfare agent with the composition that permits a reaction. After contact, the combined composition and chemical warfare agent may be agitated, stirred or rubbed to mix them together. Once contacted, the composition reacts and neutralizes the chemical warfare agent. Neutralization of the chemical warfare agent occurs with chemical degradation that decreases the effectiveness of the chemical warfare agent as a hazard to personnel.

The combination of the carbonate and peroxide generate a peroxocarbonate with an equilibrium constant shown, respectively in formulas (I) and (II), below:

$$HCO_3^- + H_2O_2 \rightleftharpoons HCO_4^- + H_2O \quad \text{(I)}$$

$$K_{eq} = \frac{[CO_4^-]\,[H_2O]}{[HCO_3^-][H_2O_2]} \quad \text{(II)}$$

The generation of peroxocarbonate from sodium bicarbonate by peroxide (urea hydrogen peroxide, 30 and 50 wt % aqueous hydrogen peroxide) was assessed using $^{13}C$ NMR. These results are shown in Table I below:

TABLE 1

Peroxocarbonate Generation from $NaHCO_3$ by Hydrogen Peroxide

| Peroxide | $[H_2O_2]$ | $[H_2O]_i$ | $[NaHCO_3]_i$ | $[HCO_3]$ | $[HCO_4^-]$ | $K_{eq}$ |
|---|---|---|---|---|---|---|
| 30 wt % | 9.8M | 43.2 M | 1.0 M | 0.20 M | 0.80 M | 20 |
| 50 wt % | 17.3M | 32.8 M | 1.0 M | 0.10 M | 0.90 M | 19 |
| Urea · $H_2O_2$ | 7.0M | 29.8 M | 0.71 M | 0.49 M | 0.22 M | 11 |

A single peak occurs near 160 ppm for bicarbonate/carbonate ($HCO_3^-/CO_3^{2-}$), and a second single peak is detected near 158 ppm for the analogous peroxocarbonates ($HCO_4^-/CO_4^{2-}$). Single peaks are observed for the pairs of species due to fast proton-exchange. Carbonate/peroxocarbonate equilibrium was reached within a matter of minutes, the rate being too fast to be measured by $^{13}C$ NMR, and persisted for at least several hours. The addition of 10 vol % of various alcohols, e.g., methanol, ethanol, isopropanol, t-butanol and polypropylene glycol, did not alter the equilibrium, and no oxidation of the alcohols occurred after several hours. Being a tertiary alcohol, t-BuOH is particularly stable towards oxidation. Other alcohols are subject to oxidation but at a much slower rate than HD. The peroxocarbonate is shown as compatible with primary and secondary, as well as tertiary, alcohols for periods of at least several hours.

The equilibrium constants ($K_{eq}$) shown in Table I ranges from about 19 and 20 for 50 wt % and 30% $H_2O_2$, respectively, to 11 for urea·$H_2O_2$. Other studies have shown a value of 14 in which $[H_2O]$ and $Na[HCO_3]$ were varied, rather than $[H_2O_2]$. Although it appears that urea·$H_2O_2$ is somewhat less effective at generating peroxocarbonate, the HD reactivity of the decontaminant formulated with this peroxide is not significantly diminished, as shown below. It is known that $K_{eq}$ is pH dependent, with $[HCO_4^-]$ maximizing at pH 7 and vanishing near pH 11. Attempts at generating peroxocarbonate using either $Na_2CO_3$ in 30% $H_2O_2$ or solid sodium percarbonate ($Na_2CO_3 \cdot 1.5H_2O_2$) in water resulted in very low yields due to the high pH values of approximately 10.5. Although the pH of the solutions shown in Table I were all approximately 8.5 (as indicated by pH paper), subtle pH differences may be contributing to the disparate values of $K_{eq}$.

Reaction of the present invention with VX provides a perhydrolysis mechanism, as is shown in formula (III) below:

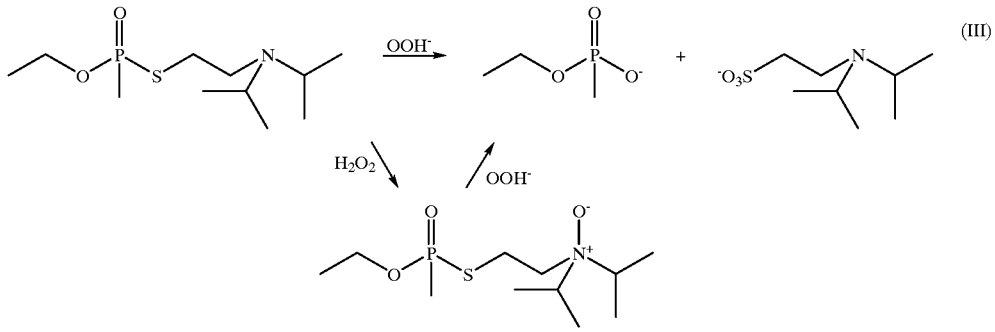

Exclusive cleavage of the P—S bond occurs to yield non-toxic ethyl methylphosphonic acid (EMPA), thus preventing formation of toxic EA-2192, which occurs via P—O bond cleavage. The cleaved thiol is oxidized to the sulfonate, consuming further $H_2O_2$. Some VX is oxidized to the N-oxide (VX—NO) which is converted to EMPA, although at a slower rate than VX. EA-2192 is a compound having the name S-2-(diisopropylamino)ethyl methyl-phosphonothioc acid.

The GB reaction with the decontaminant of the present invention is shown in formula IV, below. Competing hydrolyses by $OH^-$ and $OOH^-$ yield non-toxic isopropyl methyiphosphonic acid (IMPA) and peroxy-IMPA, respectively. The peroxy-IMPA is an intermediate, decomposing to IMPA with further consumption of $H_2O_2$ and evolution of $O_2$. The GB reaction is shown in formula (IV) below:

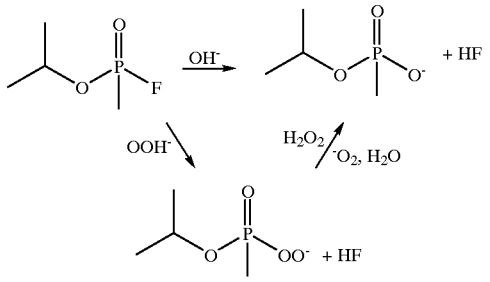

HD reaction with the decontaminant of the present invention is shown in formula (V) below. The bicarbonate functions catalytically, being oxidized to the reactive peroxocarbonate species by peroxide. Peroxocarbonate then oxidizes HD quantitatively to the non-vesicant sulfoxide (HDO), avoiding formation of the vesicant sulfone ($HDO_2$). The HD reaction is shown in formula (V) below:

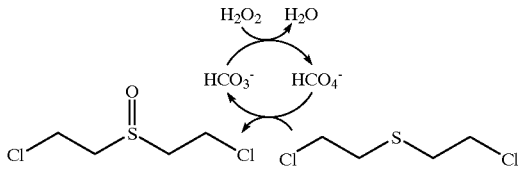

With regard to the toxicities of the sulfoxide and sulfone, although the sulfoxide is no longer a vesicant, it still retains the same mouse subcutaneous toxicity as HD itself. The sulfoxide is much preferred to the sulfone, which is nearly as potent a vesicant as HD, in addition to its substantial mouse subcutaneous and intravenous toxicity. Avoidance of sulfone production is of primary concern for an oxidant-based decontaminant, and the decontaminant of the present invention provides this critical selectivity. However, the sulfoxide product has a very slow hydrolysis rate.

EXAMPLE

Aqueous 30 and 50 wt % hydrogen peroxide ($H_2O_2$), urea hydrogen peroxide addition compound ($NH_2C(O)NH_2 \cdot H_2O_2$, 98%), and polypropylene glycol (PPG-425, avg. MW 425) were obtained from Aldrich. Decontamination solutions were mixed by first dissolving $NaHCO_3$ in the aqueous $H_2O_2$ prior to adding the alcohol. Urea hydrogen peroxide and $NaHCO_3$ were simultaneously dissolved in water before adding the alcohol. Reactions of GB, VX and HD with the decontamination solutions were monitored by $^{31}P$ and $^1H$ NMR using a Varian Unityplus 300 NMR spectrometer. In separate experiments peroxocarbonate ($NaHCO_4$) formation was assayed by $^{13}C$ NMR. Spectra were referenced to external 85% $H_3PO_4$ ($^{31}P$, 0 ppm), TMS ($^1H$, 0 ppm) and $CDCl_3$ ($^{13}C$, 77.0 ppm). Reactions were initiated by adding neat GB, VX and HD to the decontamination solution contained in a 5 mm NMR tube. The tubes were capped, wrapped with parafilm and shaken to thoroughly mix the contents. Initial concentrations of 0.01 M GB and VX, and 0.1 M HD were used.

Pseudo-first order half-lives observed for VX, GB and HD in various formulations of the decontaminant are shown in Table 2, below:

TABLE 2

Pseudo-First Order Half-Lives for VX, GB and HD

| Carbonate | Peroxide | $[H_2O_2]$ | Alcohol | VX($t_{1/2}$) | GB($t_{1/2}$) | HD($t_{1/2}$) |
|---|---|---|---|---|---|---|
| — | 1.3 ml 30% $H_2O_2$ | 4.0M (15 wt % $H_2O$) | 1.9 ml t-BuOH | 16 hours[1,2] | 29 days | 42 min |
| 0.037M $NaHCO_3$ | 1.3 ml 30% $H_2O_2$ | 4.0M (15 wt % $H_2O$) | 1.9 ml t-BuOH | 120 min[2] | <1 min[3] | 20 min |
| 0.1M $NaHCO_3$ | 1.3 ml 50% $H_2O_2$ | 7.0M (22–26 wt % $H_2O$) | 1.9 ml t-BuOH | 11 min[2] | <1 min[3] | 2.1 min |
| 0.1M $NaHCO_3$ | 1.3 ml 50% $H_2O_2$ | 7.0M (22–26 wt % $H_2O$) | 1.9 ml EtOH | — | — | 1.8 min |
| 0.1M $NaHCO_3$ | 1.3 ml 50% $H_2O_2$ | 7.0M (22–26 wt % $H_2O$) | 1.9 ml i-PrOH | — | — | 1.8 min |
| 0.1M $NaHCO_3$ | 1.3 ml 50% $H_2O_2$ | 7.0M (22–26 wt % $H_2O$) | 1.9 ml PPG-425 | — | — | 1.9 min |
| 0.33M $NaHCO_3$ | 1.3 ml 50% $H_2O_2$ | 8.7M | 1.0 ml t-BuOH | 56 sec[2] | — | — |
| 0.75M $NaHCO_3$ | 0.743 g urea•$H_2O_2$ in 1 ml $H_2O$ | 4.0M (11 wt % $H_2O$) | 1.0 ml t-BuOH | 7.5 min[2] | <1 min[3] | 1.6 min |

Notes: Superscript 1 indicates that about 50% VX/VX—NO reacted within 1 hour, but no further reaction occurred after 16 hours. Superscript 2 indicates that the time includes decay of slower-reacting VX—NO. Superscript 3 indicates that the reaction was too fast to measure.

The combined use of large $NaHCO_3$ concentrations and 50% $H_2O_2$, or high concentrations of urea·$H_2O_2$, results in a dramatic increase in the HD reaction rate relative to 30% $H_2O_2$. With sufficient concentrations of $H_2O_2$ and/or $NaHCO_3$, the half-lives of HD, VX and GB, are all driven below 2 minutes. High $NaHCO_3$ concentration provides both high $[HCO_4^-]$ for fast HD oxidation, and serves as a buffer to ensure complete VX and VX—NO perhydrolysis. Varying the alcohol co-solvent, i.e. EtOH, i-PrOH, t-BuOH and PPG-425, had minimal effect on the rate of HD reaction. Other factors such as volatility, flammability, cost, environmental concerns, and the ability to remove and solvate agent from surfaces may be considered in the selection of the proper co-solvent, as determinable by those skilled in the art.

In the most preferred form, the present invention includes a solution of baking soda, hydrogen peroxide and rubbing alcohol to rapidly decontaminate chemical warfare agents, such as VX, GB and HD. The decontaminant may be formulated with food-grade alcohols such as ethanol, propylene glycol and/or polypropylene glycol, which serve as antifreeze and co-solvent for HD. Also, solid urea hydrogen peroxide may be substituted for aqueous hydrogen peroxide. For VX, perhydrolysis yields non-toxic EMPA, and no toxic EA-2192. For GB, perhydrolysis and/or hydrolysis yields non-toxic IMPA For HD, selective oxidation to the non-vesicant sulfoxide occurs, which is not further oxidized to the sulfone, a potent vesicant.

It should be understood that the foregoing summary, detailed description, and examples of the invention are not intended to be limiting, but are only exemplary of the inventive features which are defined in the claims.

What is claimed is:

1. A method of neutralizing chemical warfare agents, comprising the steps of:

providing a composition comprising a mixture of potassium bicarbonate, a solid urea hydrogen peroxide component, and an alcohol component wherein said alcohol is selected from the group consisting of ethanol, isopropanol, propylene glycol, polypropylene glycol and derivates thereof; and, contacting a chemical warfare agent with said composition.

2. The method of claim 1, wherein said solid urea hydrogen peroxide component comprises about 50 weight percent of said mixture.

3. The method of claim 1, wherein said potassium bicarbonate is present in said mixture in a concentration of about 0.5 molar.

* * * * *